US010621808B1

(12) United States Patent
Anderson

(10) Patent No.: US 10,621,808 B1
(45) Date of Patent: Apr. 14, 2020

(54) MEDIA DIVERTER AND VALUABLE MEDIA DEPOSITORY

(71) Applicant: NCR Corporation, Atlanta, GA (US)

(72) Inventor: Stephen Anderson, Perthshire (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 16/216,594

(22) Filed: Dec. 11, 2018

(51) Int. Cl.
*G07D 11/18* (2019.01)
*B65H 29/60* (2006.01)

(52) U.S. Cl.
CPC ..... *G07D 11/18* (2019.01); *B65H 29/60* (2013.01); *B65H 2402/53* (2013.01); *B65H 2404/16* (2013.01); *B65H 2404/741* (2013.01); *B65H 2701/1912* (2013.01); *G07D 2211/00* (2013.01)

(58) Field of Classification Search
CPC ..... B65H 29/60; B65H 2402/53; B65H qj2404/16; B65H 2404/741; B65H 2404/7414; B65H 2701/1912; G07D 11/18; G07D 2211/00
USPC ..... 271/303
See application file for complete search history.

(56) References Cited

U.S. PATENT DOCUMENTS

2005/0179198 A1* 8/2005 Biegelsen ..... B65H 15/00 271/303
2010/0194033 A1* 8/2010 Berendes ..... B65H 29/60 271/239
2017/0206730 A1* 7/2017 Iwasaki ..... G07D 9/00
2018/0040189 A1* 2/2018 Chang ..... B65H 29/60

* cited by examiner

*Primary Examiner* — David H Bollinger
(74) *Attorney, Agent, or Firm* — Schwegman, Lundberg & Woessner

(57) ABSTRACT

A media diverter of a valuable media depository includes two integrated divert gates, each divert gate controlled by a separate stepper motor. The integrated divert gates are enclosed by two pivoting skid plates and two fixed skid plates. The stepper motors selectively position the integrated divert gates to define a media path for a media item from a source depository module to a destination depository module through the media diverter. In an embodiment, each of the two pivoting skid plates are adapted to be unlatched on one end to expose and provided access to different media paths for purposes of servicing media jams within the media diverter.

20 Claims, 16 Drawing Sheets

MEDIA DIVERTER AND VALUABLE MEDIA DEPOSITORY

BACKGROUND

Currency recyclers and depositories generally include a note diverter to divert notes being transported along a variety of transport pathways for: storage, ejection to an operator of the depository, and further downstream processing, such as image validation and/or escrow.

Typically, a note diverter is referred to as one of a variety of Field Replaceable Units (FRUs) within the depository. Access and replacement of FRUs are critical to the serviceability and operation of the depository. The note diverter includes a variety of components that operate together as one FRU within the depository.

Ease of access to the note diverter is vital to service the components of the note diverter, replace the note diverter, and/or free note jams that may from time to time occur within the diverter.

Because a media depository includes a wide variety of FRUs with each performing vital and independent functions, the footprint of the diverter relative to the other FRUs of the depository can present problems in terms of the serviceability and accessibility to the diverter within the depository. Additionally and conventionally, the smaller the footprint of the diverter, the more likely that notes will jam and become stuck in the diverter during normal operation of the depository.

But conventionally, larger footprint diverters require a customized design, specialized connections for connecting FRUs, and/or specialized tooling to access the diverter within the depository. Furthermore, each of the available note paths for a note being processed within the depository passes through the diverter. Some of these note paths can be bidirectional, such that the diverter must be capable of bidirectional processing of any given note processed along a variety of different transport pathways within the depository. This requires additional componentry and adds to the overall complexity of the diverter making a reduction in the footprint of the diverter difficult to achieve.

Additionally, as more and more functionality is added to FRUs that are interfaced to the diverter within the depository, the complexity and correspondingly the sizes of these interfaced FRUs are increasing. However, depositories are already bulky with large footprints and there is no interest in the industry for increasing the overall size of the depositories. In fact, the goal of the industry is to reduce the size of the depositories.

Therefore, a smaller footprint diverter that improves on serviceability and accessibility of the conventional diverter, while reducing note jams and improving on the overall efficiencies of the conventional diverter is needed.

SUMMARY

In various embodiments, a method of operating a novel media diverter within a valuable media depository, the novel media diverter, and a valuable media depository having the novel media diverter are provided.

In one embodiment, a method of operating a novel media diverter is provided. A media item is urged, from a source depository module to a destination depository module, by selectively moving at least one of two integrated divert gates along a media path, each of the two integrated divert gates moved by a separate stepper motor associated with that integrated divert gate. Bidirectional rollers are controlled along at least a portion of the media path by a single bidirectional motor when at least one of the source depository module and the destination depository module is associated with either a pocket module or a safe module.

According to another embodiment, a novel media diverter is presented. The media diverter includes: a first integrated divert gate enclosed within four skid plates, a second integrated divert gate enclosed within the four skid plates, a first stepper motor configured to selective position and move the first integrated divert gate; and a second stepper motor configured to selectively position and move the second integrated divert gate. The media diverter is configured to selective position the first integrated divert gate through the first stepper motor and selective position the second integrated divert gate through the second stepper motor. Selectively positioning of the integrated diver gates defines a media path to urge a media item from a source depository module to a destination depository module through the valuable media diverter.

In still another embodiment, a valuable media depository is presented. The valuable media depository includes a controller and a valuable media diverter. The valuable media diverter includes a first integrated divert gate configured to be controlled by a first stepper motor, a second integrated divert gate configured to be controlled by a second stepper motor, two pivoting skid plates, and two fixed skid plates. The two pivoting skid plates and the two fixed skid plates enclose the first integrated divert gate and the second integrated divert gate. The first stepper motor and the second stepper motor are configured to position the first integrated divert gate and the second integrated divert gate to define a media path to urge a media item from a source valuable depository module to a destination valuable depository module through the media diverter. The controller is configured to selectively activate the first stepper motor and the second step motor based on the source valuable depository module and the destination valuable depository module.

DETAILED DESCRIPTION

Figure 1A:
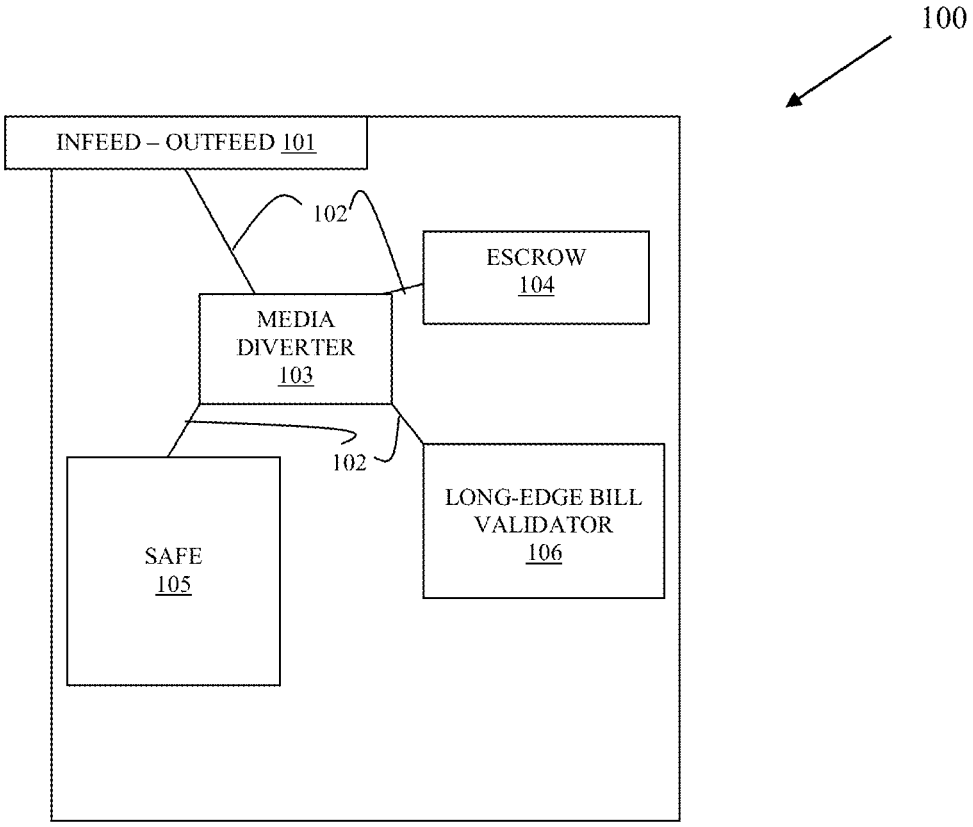
FIG. 1A is a diagram of a valuable media depository having a media diverter, according to an example embodiment.

FIG. 1A is a diagram of a valuable media depository 100 having a novel media diverter 103, according to an example embodiment (also referred to as the diverter 103). It is to be noted that the valuable media depository 100 is shown with only those components relevant to understanding what has been added and modified to a conventional depository for purposes of providing the diverter 103 into the depository 100.

The depository 100 is suitable for use within an Automated Teller Machine (ATM), which can be utilized to process deposited banknotes and checks (valuable media as a mixed bunch if desired). The deposit module 100 has an infeed and outfeed module 101 (media or document infeed or ejection) through which incoming checks and/or banknotes are deposited or outgoing checks and/or banknotes are dispensed. This infeed and outfeed module 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport paths 102 away from the infeed and outfeed mouth 101. They may then pass through a novel diverter 103 (discussed more completely herein and below) and travel along a different transport path 102. Along the various paths 102, the media may be obtained from or provided to an escrow 104, a safe 105, and/or a Long Edge Bill Validator (LEBV) 106.

Along the various transport paths 102 a variety of other modules may be deployed for processing the media in some manner, such as a bill/note separator module, a bill/note deskew module, a re-buncher module, and/or a various position sensors and/or image sensors.

As used herein, the phrase "valuable media" refers to media of value, such as currency, coupons, checks, negotiable instruments, value tickets, and the like.

For purposes of the discussions that follow with respect to the FIGS. 1A-1M, "valuable media" is referred to as currency and the "valuable media depository 100" is referred to as a "depository 100." Additionally, valuable media may be referred to as a "document" and/or a "note" herein.

Figure 1B:
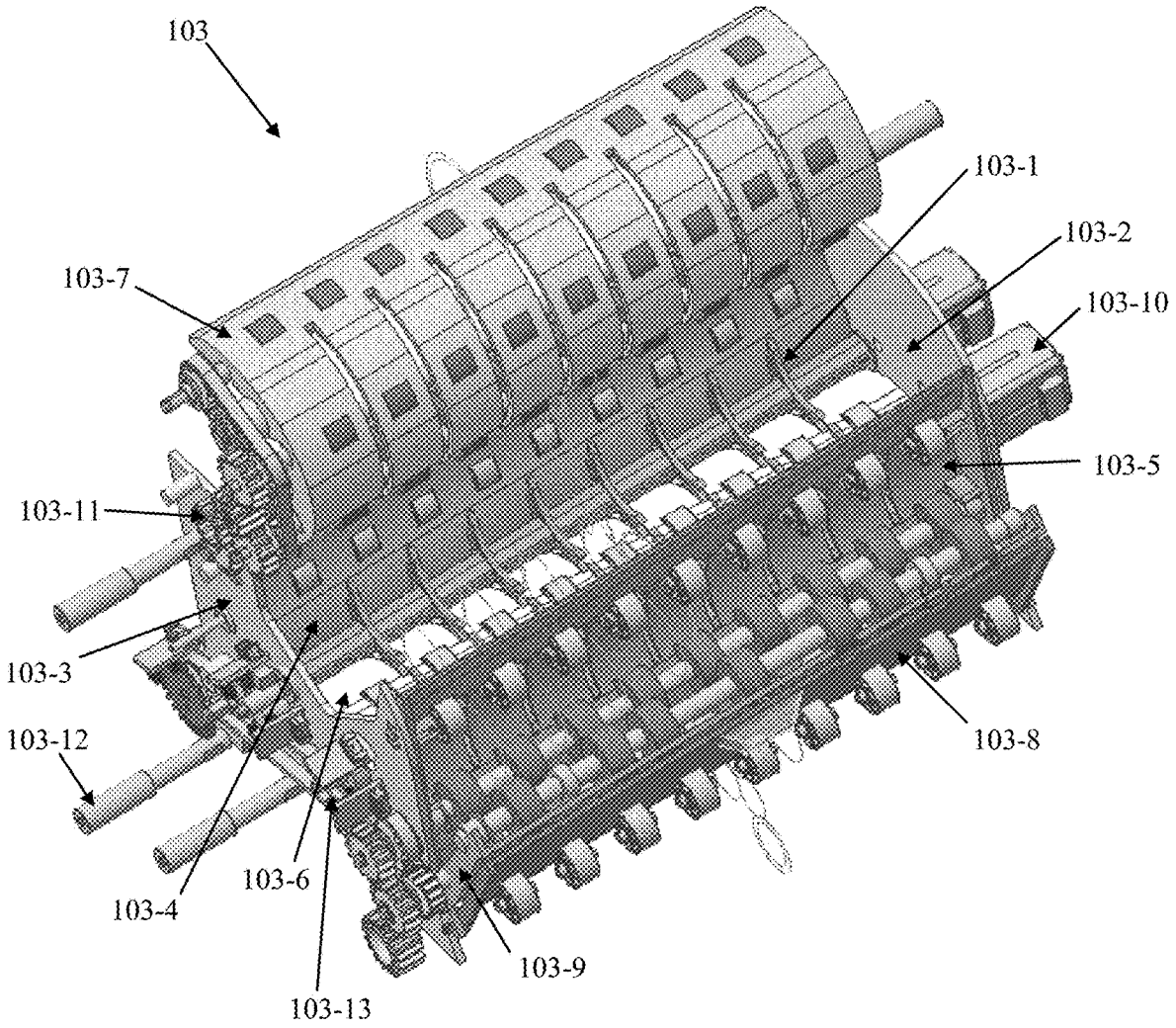
FIG. 1B is a diagram of a top-down view of the media diverter, according to an example embodiment.

FIG. 1B is a diagram of a top-down view of the novel media diverter 103, according to an example embodiment.

The diverter 103 includes: a first integrated divert gate 103-1, a sheet metal gable 103-2 with a stepper motor mounting, a second sheet metal gable with transport drive and gate sensor mounting 103-3, a lower fixed skid plate 103-4, an upper fixed skid plate 103-5, a service access pivoting skid plate—front 103-6, a service access pivoting rear skid plate 103-7, a service access pivoting skid plate for upper infeed 103-8, a service access pivoting skid plate for lower infeed 103-9, an integrated gate drive—stepper motor 103-10, a belt/gear drive arrangement—drive roller 103-11, mounting studs for mounting the diverter 103 within the depository 103-12, and a second integrated divert gate with position sensor 103-13.

Only those components of the diverter 103 that are necessary for understanding the teachings presented herein are labeled in the FIGS. 1B-1M that follow.

Aptly, the diverter 103 includes two integrated divert gates 103-1 and 103-13 that are nested between four main skid plates 103-4, 103-5, 103-6, and 103-7. This provides a compact and space efficient arrangement for the depository 103 where the gates 103-1 and 103-13 are stoked through 120 degrees to divert media between four unique media feed and media receive modules (infeed/outfeed 101, escrow 104, safe 105, and LEBV 106. The media paths (discussed with the FIG. 1D below) available through the diverter 103 are compact (densely packed), such that media jams are reduced while maintaining a small footprint for the diverter 103 within the depository 100. This configuration and structure also provides functionality for improved serviceability and accessibility to the components of the diverter 103 and to the connecting FRUs (infeed/outfeed 101, escrow 104, safe 105, and LEBV 106) while maximizing clearance for access to the connecting FRUs (infeed/outfeed 101, escrow 104, safe 105, and LEBV 106) without specialized tooling being required for such access (as has conventionally been the case). The configuration/structure of the diverter 103 also provides a low cost to manufacture diverter 103 having a significantly smaller footprint with the depositor 100 than conventional diverters.

Moreover, the configuration/structure of the diverter 103 supports four media paths through the diverter 103 while accounting for the fact that two of the four media paths require bidirectional transport, driven from a bidirectional motor 103-118 (shown in at least FIG. 1C below) and mounted on the diverter 103. This allows the media to pass into and out of the pocket 101 (also referred to herein as "infeed and outfeed module 101") and to pass into and out of the safe 105 (also referred to herein as "intermediate transport safe 105"). The diverter 103 also transfers control to the passive intermediate transport drive interface 105-1 (shown at least in FIG. 1F below) of the safe 105 that remains fixed in an aperture within the safe top. The two remaining media paths through the diverter 103 are unidirectional and driven from a main detector loop drivetrain 103-11.

Figure 1C:
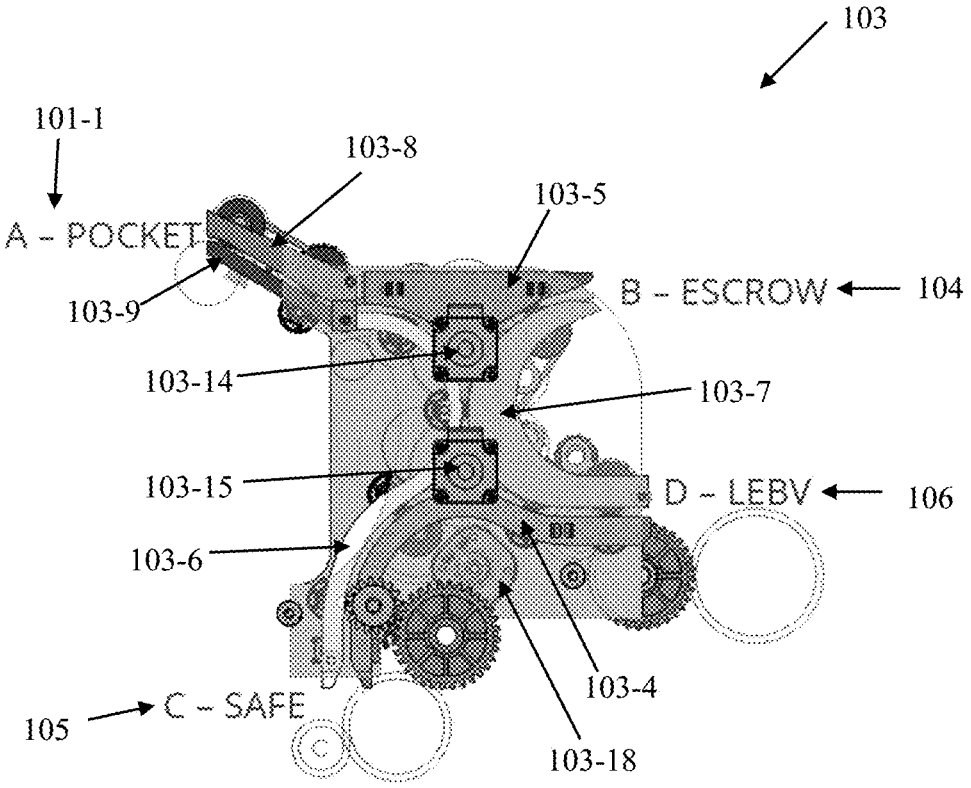
FIG. 1C is a diagram of a side view of the media diverter, according to an example embodiment.

FIG. 1C is a diagram of a side view of the media diverter 103, according to an example embodiment.

The FIG. 1C illustrates the arrangement of the 4 skid plates 103-4, 103-5, 103-6, and 103-7 in relation to one another within the diverter 103. The home position of the service access pivoting skid plate for the upper infeed 103-8 in relation to the pocket 101. The infeed/outfeed to and from the safe 105, the infeed to the escrow 104, and the infeed to the LEBV 106.

Adeptly, the FIG. 1C also illustrates two stepper motors 103-14 and 103-15. Each stepper motor 103-14 or 103-15 controls one of the integrated divert gates 103-1 or 103-13. Each stepper motor 103-14 or 103-15 provides a 120 degree stoke for the integrated divert gate 103-1 or 103-13 that it controls. This configuration ensures accuracy in positioning of the gates 103-1 and 103-13 and significantly reduces the necessary componentry of the diverter 100 from conventional diverters and significantly reduces assembly complexity of the diverter 100 from conventional diverters.

The bidirectional motor 103-118 is situated below the lower fixed plate 103-4, and as stated above controls bidirectional media transport into and out of the pocket 103 and the safe 105.

The base of the diverter 100 includes two opposing side plates 103-4 (lower) and 103-5 (upper). One of the side plates is used to mount the stepper motors 103-14 and 103-15 and the drive interface with the passive intermediate transport 105-1. The opposite side plate includes the belt/gear drive arrangement 103-11 to transfer drive to each of the shaft/rollers that contact the media.

The skid plates 103-6 and 103-7 pivot to allow service access to the note path associated with the rollers 103-16 and 103-17 (FIG. 1E), gates 103-1 and 103-13, and corresponding track sensors (not shown in the FIGS). A bridge transport links/interfaces the diverter 103 to the pocket 101.

Figure 1D:
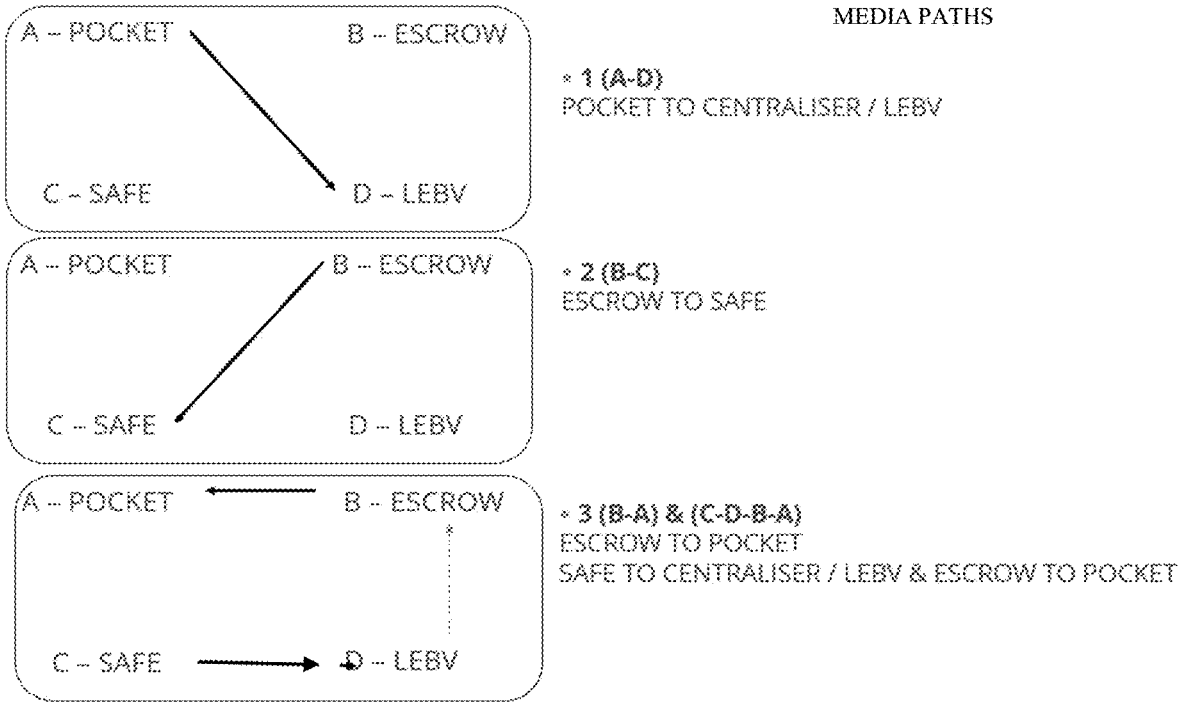
FIG. 1D is a diagram depicting valuable media paths through the media diverter during operation of the media diverter, according to an example embodiment.

FIG. 1D is a diagram depicting valuable media paths through the media diverter 103 during operation of the media diverter 103, according to an example embodiment.

As illustrated in the FIG. 1D, a first media path permits direct transfer of the media from the pocket A 101 to the LEBV D 106. A second media path permits direct transfer of the media from the escrow B 104 to the safe C 105. A third media path permits direct transfer of the media from the escrow B 104 to the pocket A 101. A fourth media path permits direct transfer of the media from the safe C 105 to the LEBV D 106. Optionally, a fifth media path permits direct transfer of the media from the LEBV D 106 to the escrow B 104.

Figure 1E:
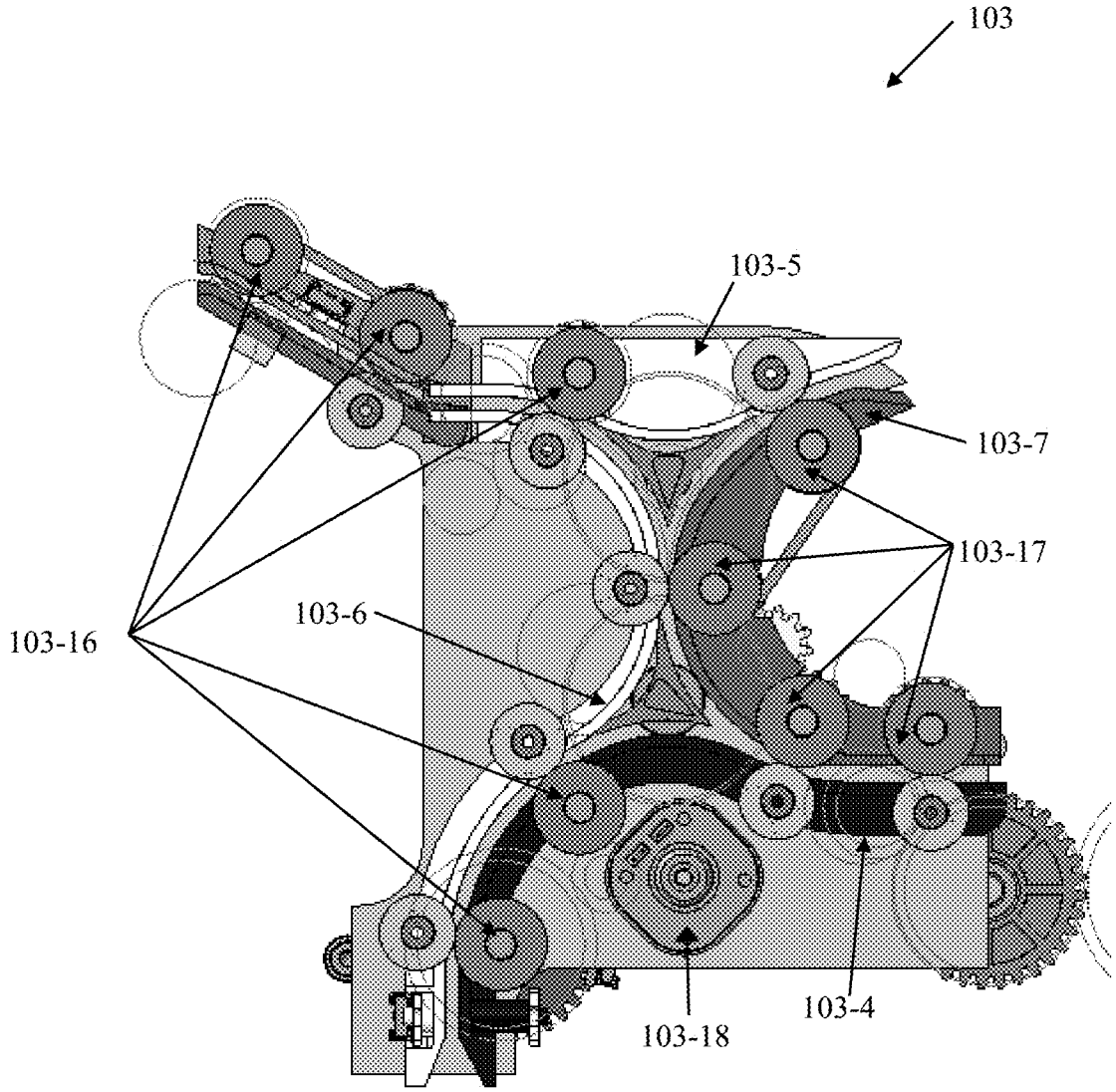
FIG. 1E is a diagram of another side view of the media diverter illustrating a set of bidirectional driven rollers and a set of unidirectional driven rollers, according to an example embodiment.

FIG. 1E is a diagram of another side view of the media diverter 103 illustrating a set of bidirectional driven rollers 103-16 and a set of unidirectional driven rollers 103-17, according to an example embodiment.

The bidirectional driven rollers 103-16 are driven by the bidirectional motor 103-18. The unidirectional rollers 103-17 are driven by the intermediate transfer interface 105-1. Each gate 103-1 and 103-13 is driven by one of the stepper motors 103-14 and 103-15.

Figure 1F:
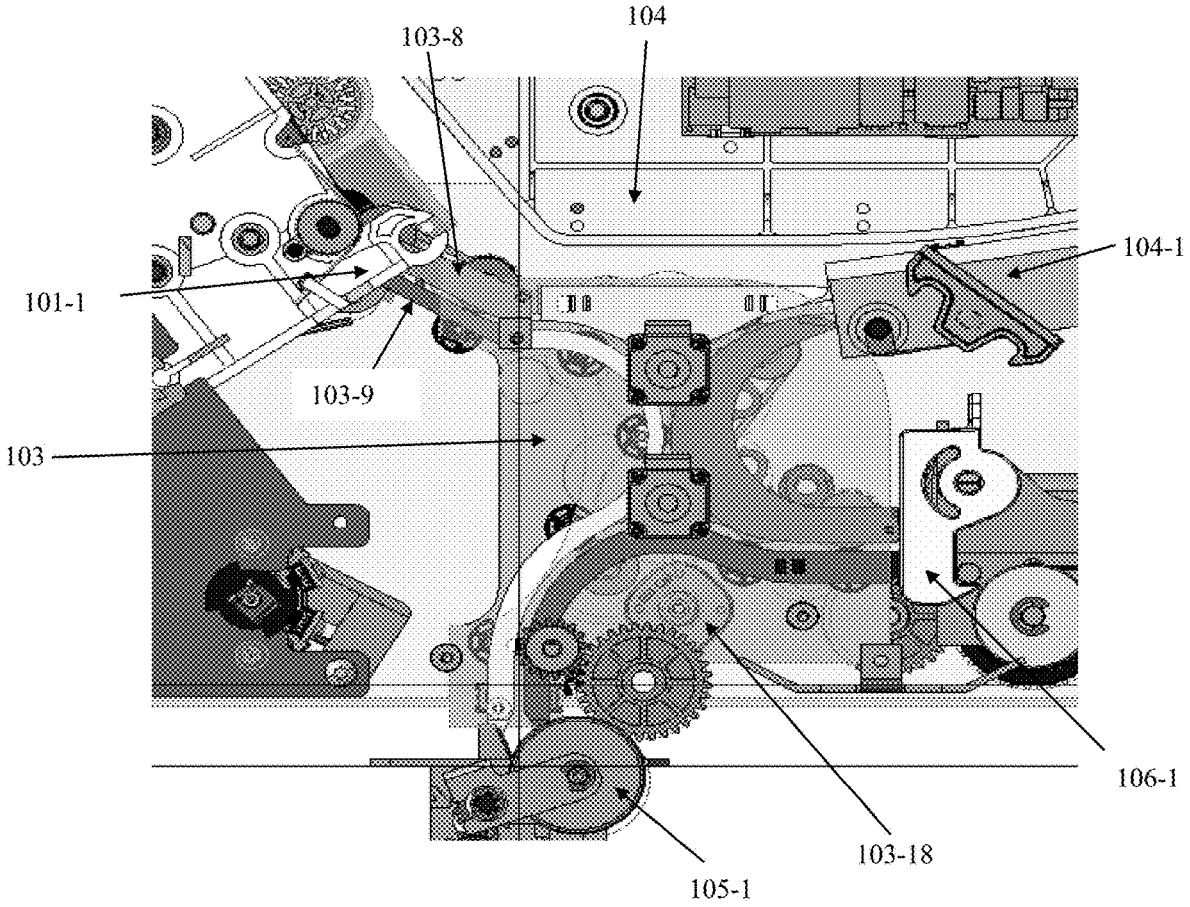
FIG. 1F is a diagram depicting the media diverter in a home position and integrated into the media depository to four other FRUs of the media depository, according to an example embodiment.

FIG. 1F is a diagram depicting the media diverter 103 in a home position and integrated into the media depository 103 to four other FRUs (101, 104, 105, and 106) of the media depository 100, according to an example embodiment.

The service access pivoting skid plate for upper infeed 103-8 and the service access pivoting skid plate for lower infeed 103-9 are in the home position (adjacent to one other with 103-8 on top of 103-9 with a gap between the two permitting media to pass there between). The upper infeed skid pate 103-8 and the lower infeed skid plate 103-9 coupled together along one end furthest away from the pocket infeed interface 101-1. An end of 103-8 and 103-9 that is uncoupled from one another is adapted to align with or attach to (such as through a latch or snapping mechanism) the pocket infeed interface 101-1 of the pocket 101. An upper end of the pivoting skid plate 103-7 is aligned to or attached to the escrow return transport 104-1 of the escrow 104. A lower end of the fixed lower skid plate 103-4 and a lower end of the pivoting skid plate 103-6 are aligned on top of or attached to the intermediate transport drive interface 105-1.

The FIG. 1F illustrates the diverter 103 in a fully operational mode within the depository 100. A controller of the depository 100 is connected through electronic ports or a circuit board, such that the controller selectively activates and deactivates the bidirectional motor 103-18 and the stepper motors 103-14 and 103-15. The operation being processed causes the controller to cause the gates 103-1 and 103-3 to selectively open and close up to 120 degrees directing media along track of the depository 100 to be diverted in 1 of 4 directions associated with the pocket 101, the escrow 104, the safe 105, and the LEBV. The media may be directed by the selective activation of the gates 103-1 and 103-3 along any of the paths discussed above with the FIG. 1D (up to 5 pathways).

Figure 1G:
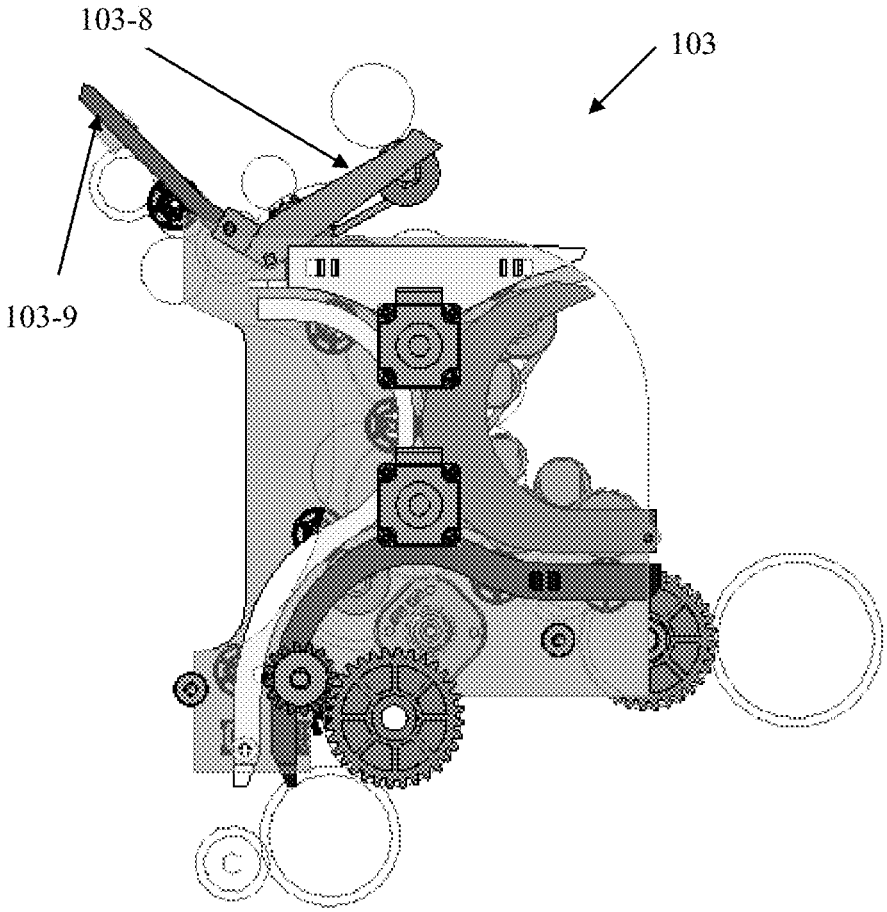
FIG. 1G is a diagram depicting a side view of the media diverter in a position for access to the pocket interface FRU, according to an example embodiment.

FIG. 1G is a diagram depicting a side view of the media diverter 103 in a position for access to the pocket interface, according to an example embodiment.

The skid plate for the upper infeed 103-8 is adjustable and movable away from the skid plate for the lower infeed 103-9 by greater than 90 degrees as illustrated in the FIG. 1G. The slit between 103-8 and 103-9 is enlarged from that which was shown in the home position of the FIG. 1F above and the gap between 103-8 and 103-9 is substantially enlarged.

Jam access to the pocket bridge (103-8 and 103-9 combined) is enabled by moving 103-8 away from 103-9. 103-8 and 103-9 pivotally connected on a stationary end of the two skid plates 103-8 and 103-9. This causes the bridge transport to pivot back allowing service access from the top of the diverter 103.

Figure 1H:
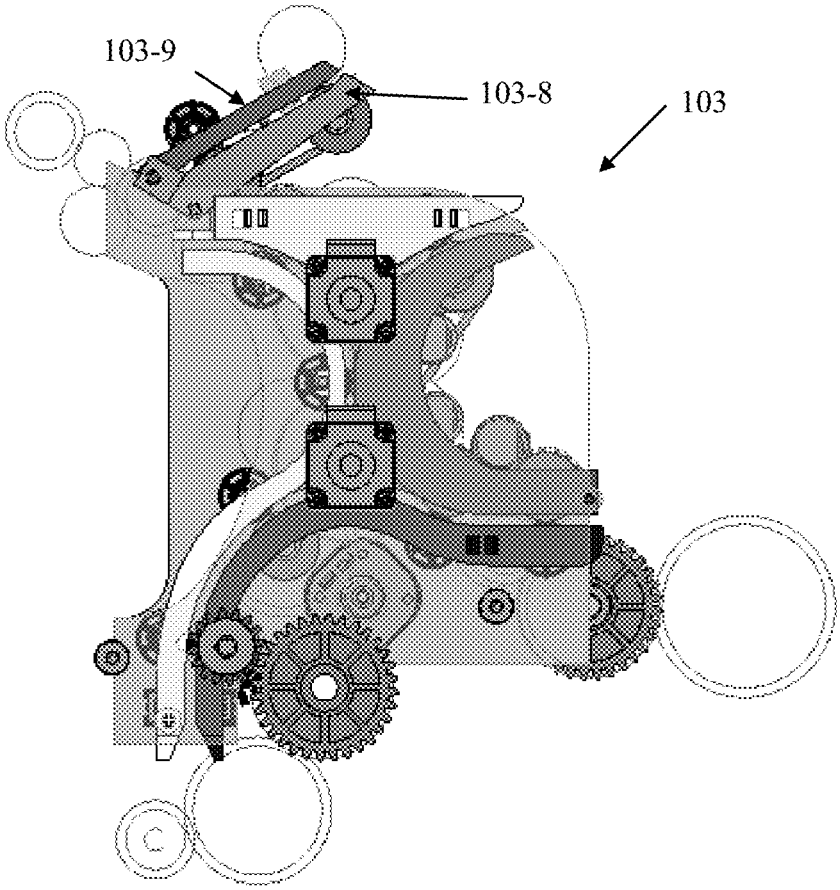
FIG. 1H is a diagram depicting a side view of the media diverter in an initial position for clearing a front skid jam associated with the valuable media, according to an example embodiment.

FIG. 1H is a diagram depicting a side view of the media diverter 103 in an initial position for clearing a front skid jam associated with the valuable media, according to an example embodiment.

In the FIG. 1H, similar to the skid plate for the upper infeed 103-8, the skid plate for the lower infeed 103-9 can be moved from the initial home position in the direction of the moved skid plate for the upper infeed 103-8 (as shown in the FIG. 1G) to bring both 103-8 and 103-9 adjacent to one another and away from the pocket interface 101-1.

This allows the pocket bridge (103-8 and 103-9) to rotate back together on top of the main assembly for the diverter 103. The front skid plate 103-6 can then be unlatched and pivoted forward to enable service access into the front of the assembly for the diverter 103, as depicted in the FIG. 1I.

Figure 1I:
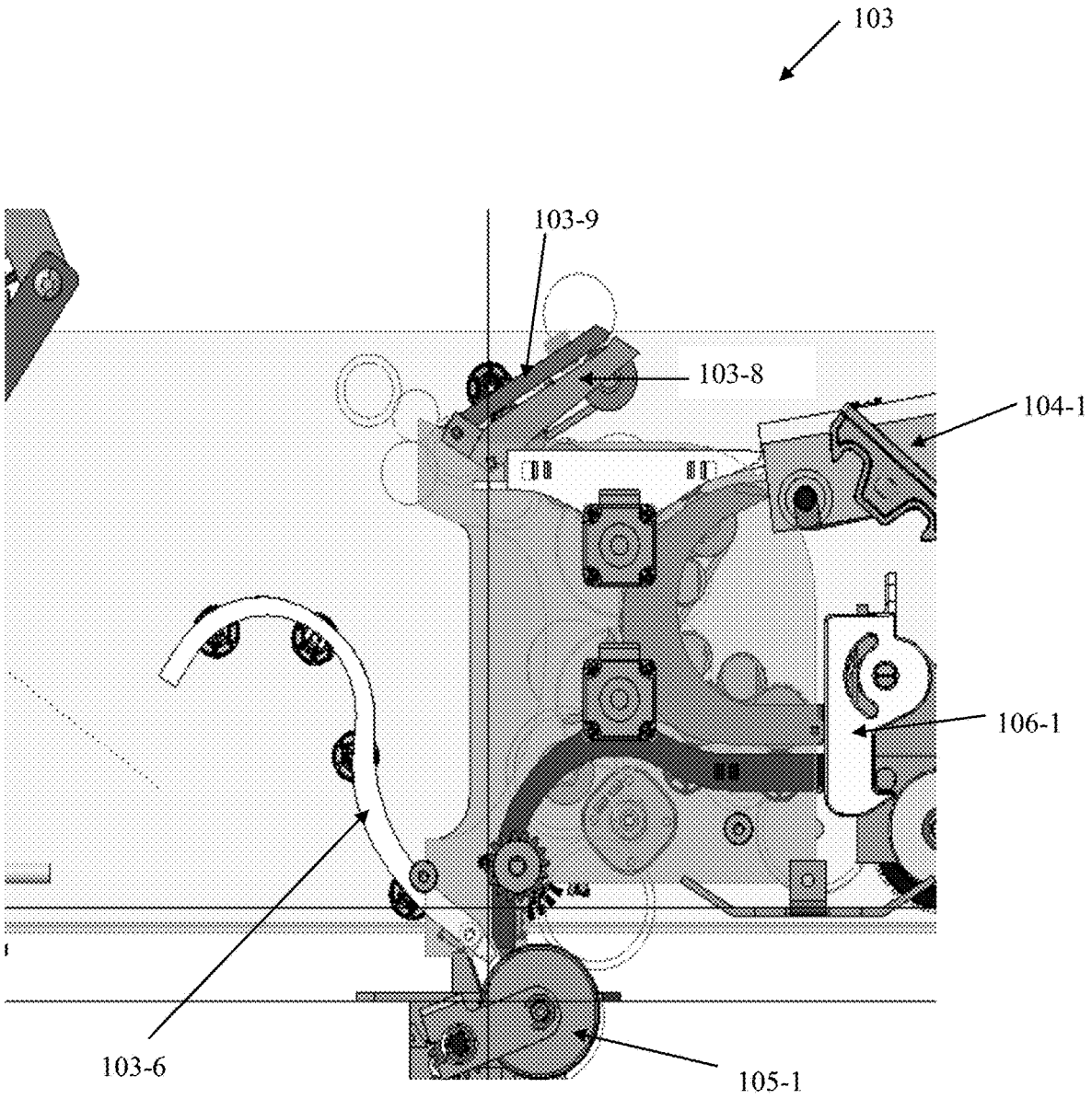
FIG. 1I is a diagram depicting a side view of the media diverter in a second position for clearing the front skid jam associated with the valuable media within the media depository, according to an example embodiment.
Figure 1J:
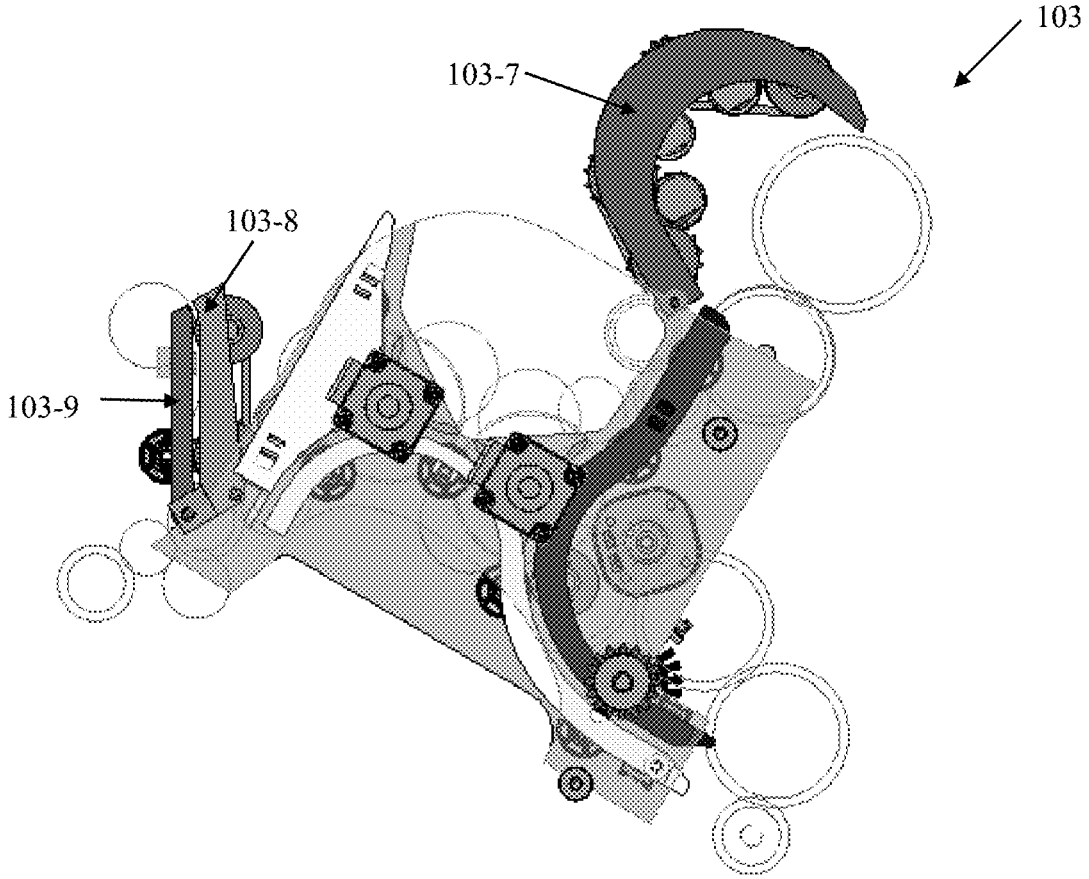
FIG. 1J is a diagram depicting a side view of the media diverter in a position for clearing a rear skid jam associated with the valuable media, according to an example embodiment.

FIG. 1J is a diagram depicting a side view of the media diverter 103 in a position for clearing a rear skid jam 103-7 associated with the valuable media, according to an example embodiment.

Figure 1K:
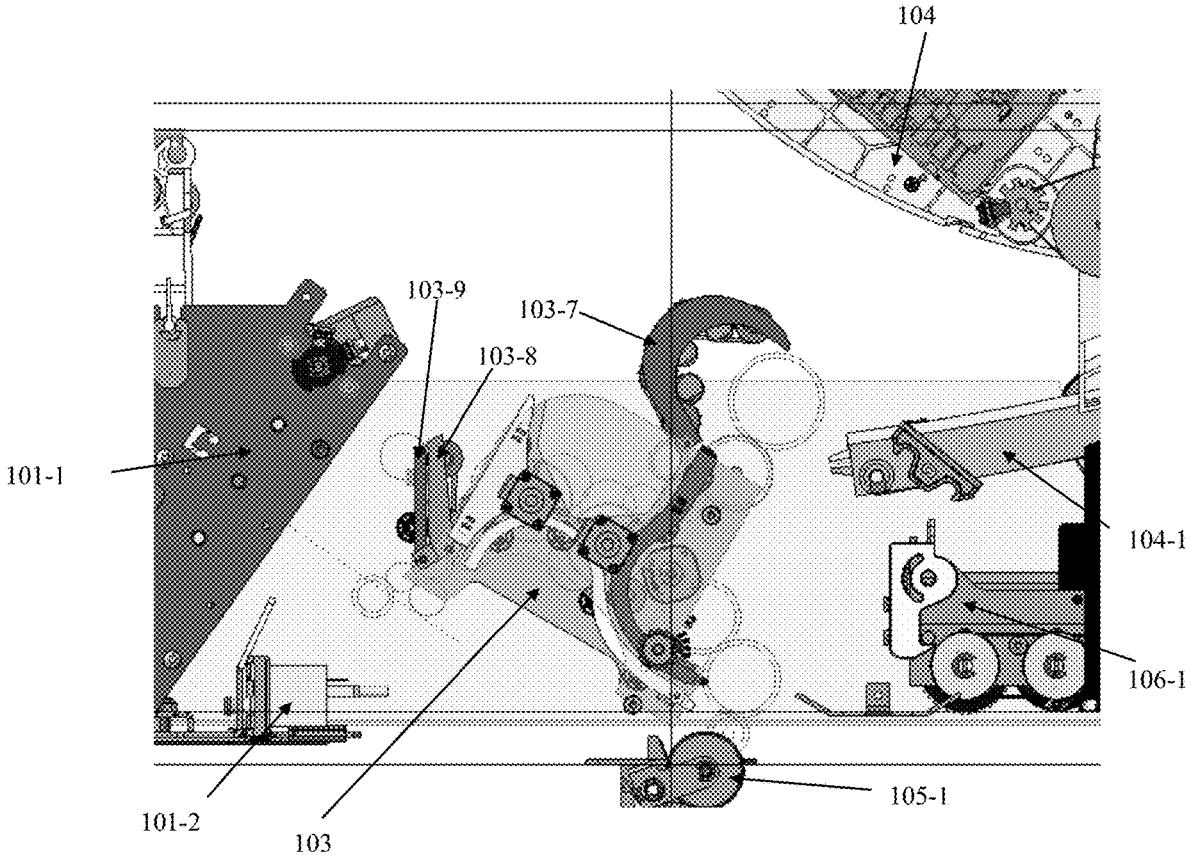
FIG. 1K is a diagram depicting positions of the FRUs within the media depository when clearing a rear skid jam associated with the valuable media, according to an example embodiment.

With the pocket bridge (103-8 and 103-9) moved to the top of the diverter 103 assembly with the front skid plate 103-6 latched (as shown in the FIG. 1H), the entire diverter 103 assembly is rotated forward approximately 60 degrees (as shown in the FIG. 1K). In this position, the rear-skid plate 103-7 can be unlatched and pivoted back. This allows service access to the opposite side of the media path from that which was depicted in the FIG. 1I.

Figure 1L:
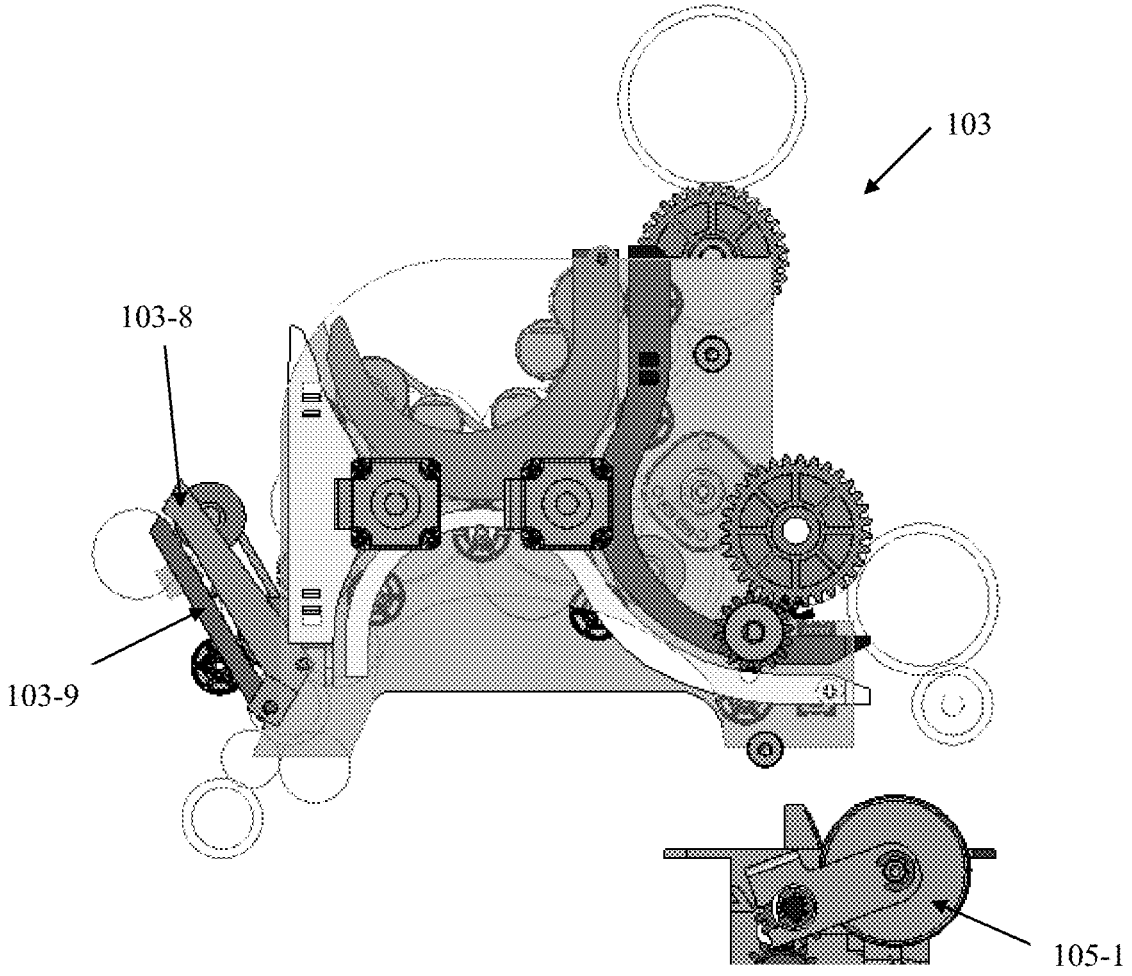
FIG. 1L is a diagram depicting a position of the media diverter when servicing a centralizer, according to an example embodiment.
Figure 1M:
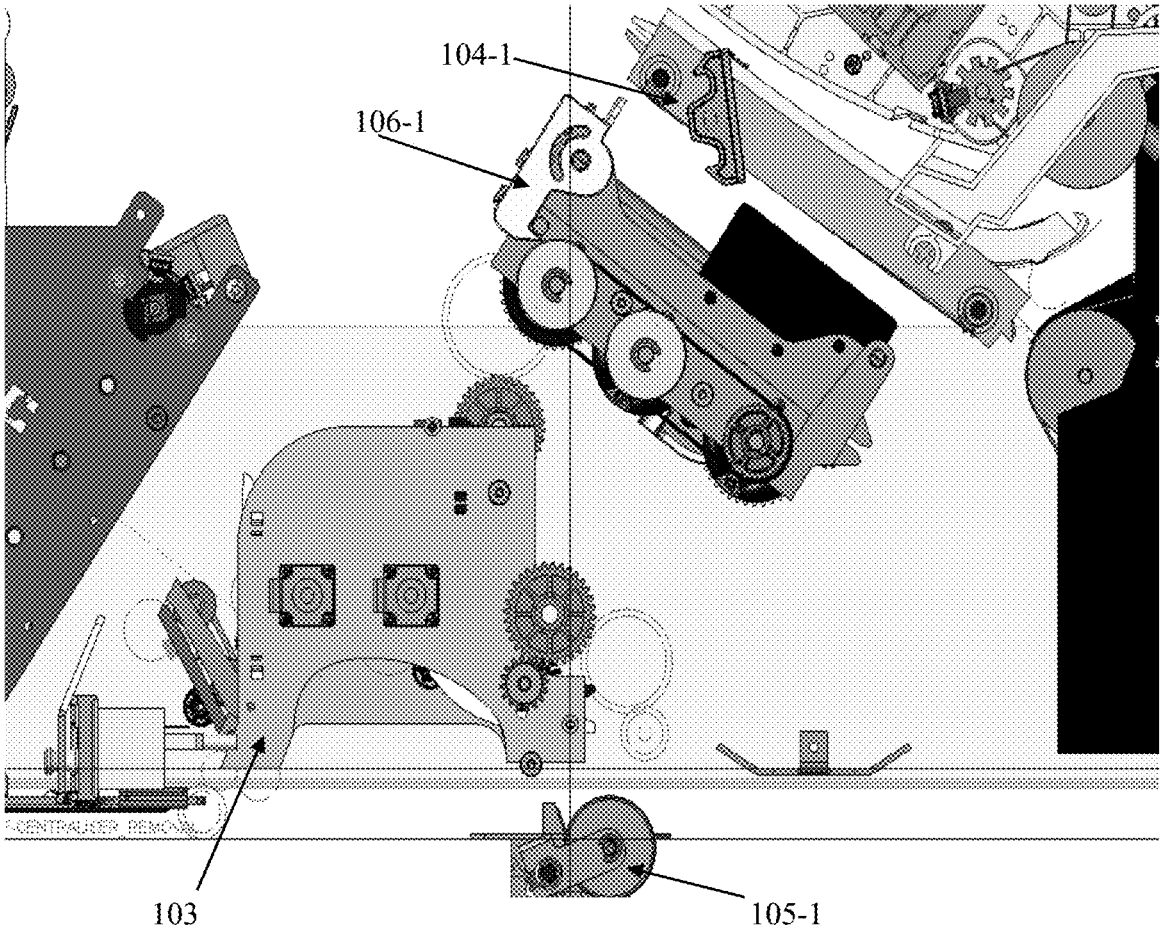
FIG. 1M is a diagram depicting positions of the media diverter and the interfaced FRUs when the centralizer is removed from the media depository of clearing a valuable media jam within the centralizer, according to an example embodiment.

FIG. 1L is a diagram depicting a position of the media diverter 103 when servicing a centralizer 106-1, according to an example embodiment.

The entire diverter 103 assembly is rotated through 90 degrees within the media depository (as shown in the FIG.

1M). This arrangement maximizes the clearance between the diverter 103 and the escrow transport interface 104-1 to facilitate effective service access to the centralizer 106-1 and removal of the centralizer 106-1 without removing the entire diverter 103 assembly as shown in the FIG. 1M).

The arrangement/configuration of the various components of the diverter 103 provide a compact diverter 103 FRU with an upper depository 100 module. This also reduces the number of moving parts while improving accessibility and serviceability of both the components of the diverter 103 and other FRUs of the depository 100, such as the centralizer 106-1, the pocket 101, the escrow 104, the safe top of the safe 105, and the LEBV 106. Furthermore, both sides of the gates 103-1 and 103-13 can be accessed. Moreover, no specialized tooling is needed as componentry latches and unlatches into the skid plate geometry of the diverter 103 retaining the componentry parts against the side plates. Additionally, directly coupling the gates 103-1 and 103-13 to the bidirectional motor 103-18 eliminates float in the gates 103-1 and 103-13 and improves reliability in the overall operation of the diverter 103 and longevity of the diverter 103, which reduces overall costs of ownership with respect to the depository 100. The arrangement/configuration of the diverter 103 also provides a detector loop transport, which can lead to improvements in the functionality of the escrow FRU 104 and other FRUs of the depository 100.

In an embodiment, the depository 100 that includes the diverter 103 is integrated into an Automated Teller Machine (ATM).

In an embodiment, the depository 100 that includes the diverter 103 is integrated into a Point-Of-Sale (POS) terminal.

In an embodiment, the depository 100 that includes the diverter 103 is integrated into a Self-Service Terminal (SST).

The above-discussed embodiments and other embodiments are now discussed with reference to the FIGS. 2-4.

Figure 2:
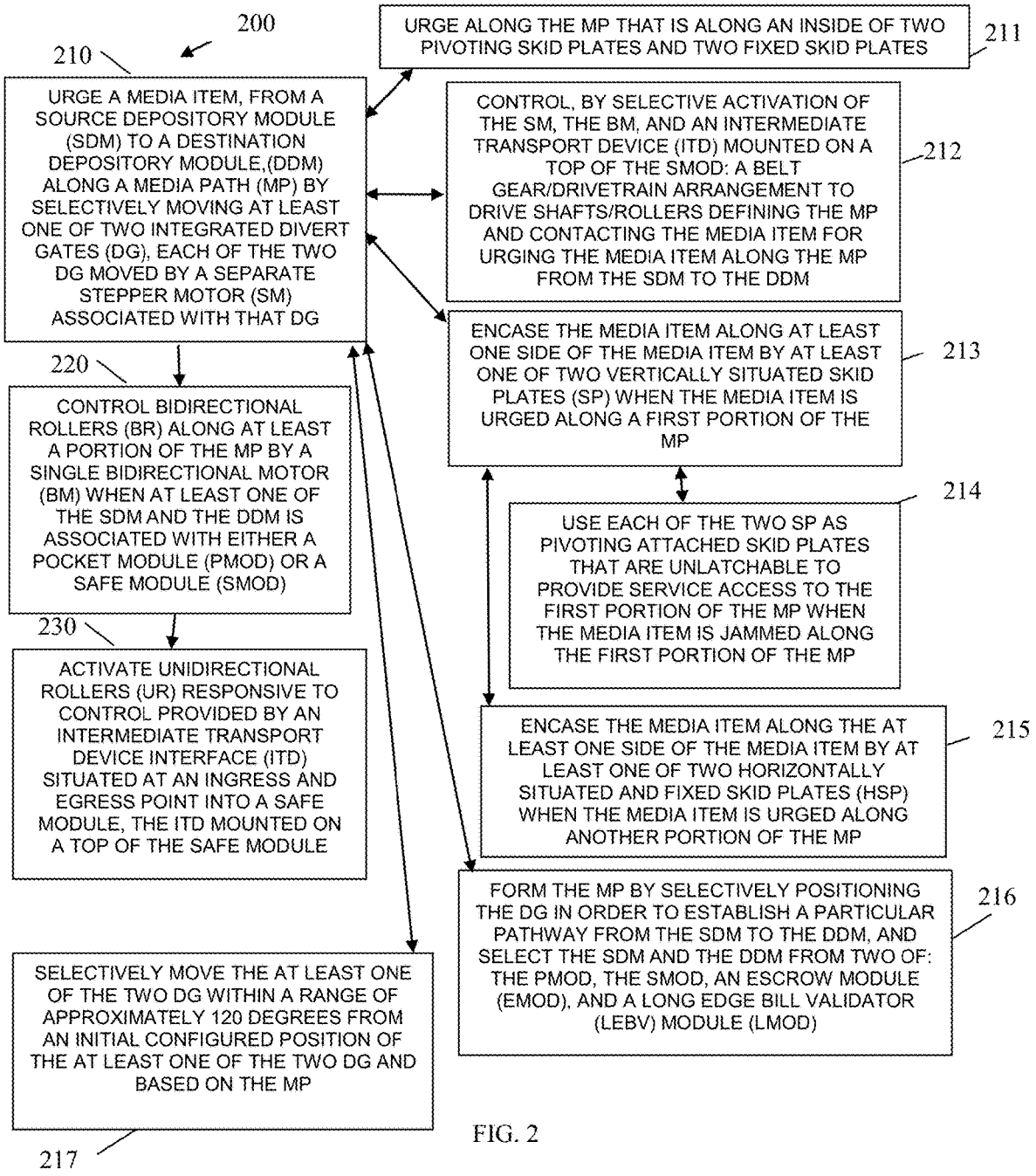
FIG. 2 is a diagram of a method for operating the media diverter, according to an example embodiment.

FIG. 2 is a diagram of a method 200 for operating the novel diverter 103, according to an example embodiment. The method 150 is implemented as firmware instructions programmed and loaded into a motherboard that is connected to the diverter 103 through electronic componentry (such as an electronic circuit board). The firmware instructions reside within a non-transitory medium on modules interfaced to the motherboard (memory module(s) and/or storage module(s)). One or more hardware processors of the motherboard execute the firmware instructions. The method 200 is herein referred to as a controller.

In an embodiment, the controller is located on a circuit board that is located within the depository 100 separate from the diverter 103.

In an embodiment, the controller is located on a circuit board that is located within diverter 103 and communicates with a centralized controller located within the depository 100.

In an embodiment, the depository 100 is integrated within an ATM.

In an embodiment, the depository 100 is integrated within a POS terminal.

In an embodiment, the depository 100 is integrated within a SST.

In an embodiment, the diverter is the diverter 100 discussed above.

In an embodiment, the diverter is a 4-way media diverter supporting redirection of media being processed by FRUs within the depository 100 in four directions.

In an embodiment, the diverter is capable of supporting at least 5 media paths from one of four source FRUs to one of four destination FRUs within the depository 100.

At 210, the controller urges a media item, from a source depository module (source FRU that is interfaced to the diverter within the depository) to a destination depository module (destination FRU that is also interfaced to the diverter within the depository) along a media path, by selectively moving at least one of two integrated divert gates 103-1 and 103-13. Each of the two integrated divert gates 103-1 and 103-13 moved by a separate stepper motor 103-14 or 103-15 associated with that divert gate 103-1 or 103-13.

In an embodiment, at 211, the controller, urging the media item along the media path that is along an inside portion of two pivoting skid 103-6 and 103-7 plates and two fixed skid plates 103-4 and 103-5 from a source infeed associated with the source depository module (source FRU) to a destination outfeed associated with the destination depository module (destination FRU).

In an embodiment, at 212, the controller controls, selective activation of the stepper motors 103-14 and 103-15, the bidirectional motor 103-118, and an intermediate transport device 105-1 mounted on top of a safe module (safe FRU) that is interfaced to the diverter for activating and controlling: a belt gear/drivetrain arrangement to drive shafts/rollers in order to define the media path. Some of the controlled and activated items contact the media item for urging (transporting) the media item along the media path from the source FRU to the destination FRU.

In an embodiment, at 213, the controller encases the media item along at least one side of the media item by at least one of two vertically situated skid plates 103-6 and 103-7 when the media item is urged along a first portion of the media path within the diverter.

In an embodiment of 213 and at 214, the controller uses each of the two vertically situated skid plates 103-6 and 103-7 as pivoting attached skid plates that are unlatchable to provide service access to the first portion of the media path when the media item is jammed along the first portion of the media path within the diverter.

In an embodiment of 213 and at 215, the controller encases the media item along the one side of the media item by at least one of two horizontally situated and fixed skid plates 103-4 and 103-5 when the media item is urged along another portion of the media path within the diverter.

In an embodiment, at 216, the controller forming the media path by selectively positioning the at least one of the two integrated divert gates 103-1 and 103-13 in order to establish a particular pathway from the source depository module to the destination depository module, and selecting the source depository module and the destination depository module from two of: the pocket module 101, the safe module 105, an escrow module 104, and a Long Edge Bill Validator (LEBV) module 106.

In an embodiment, at 217, the controller selective moves at least one of the two divert gates 103-1 and 103-13 within a range of approximately 120 degrees from an initial configured position of the two divert gates 103-1 and 103-13 when defining and based on the media path.

At 220, the controller controls bidirectional rollers 103-16 when at least one of the source FRU and the destination FRU is associated with either the pocket module (pocket 101 or pocket FRU) or a safe module (safe 105 or safe FRU).

According to an embodiment, the controller activates unidirectional rollers 103-17 responsive to control provided by an intermediate transport device 105-1 situated at an ingress and egress point into a safe module (safe 105 or safe FRU) that is mounted on top of the safe module.

Figure 3:
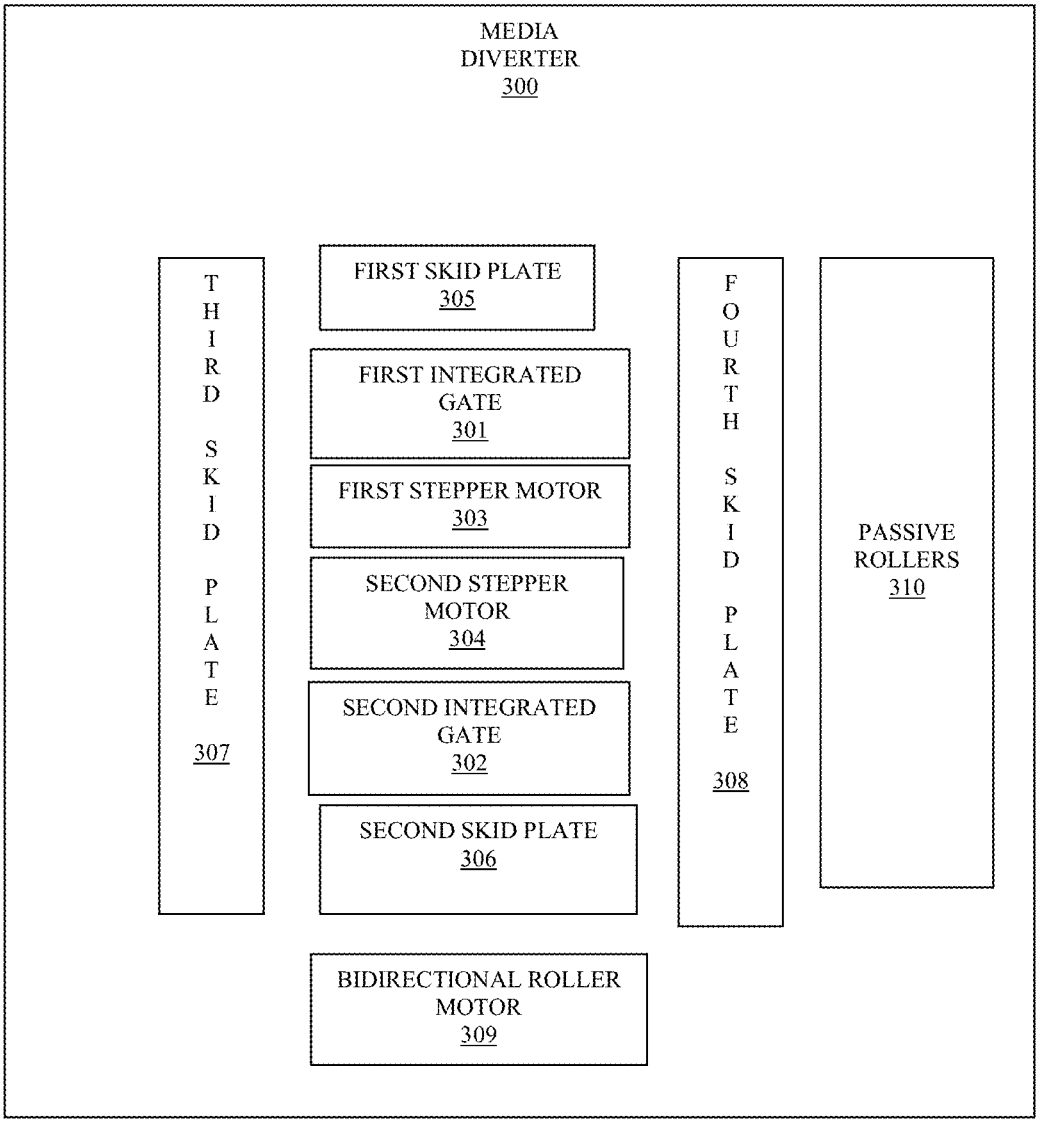
FIG. 3 is another diagram of the media diverter, according to an example embodiment.

FIG. 3 is another diagram of a valuable media diverter 300 (diverter 300), according to an example embodiment. The diverter 300 is interfaced within a depository 100 to four FRUs (pocket 101, escrow 104, safe 105, and LEBV 106). The diverter 300 controls a media path within the diverter 300 for moving a media time from a source FRU (source depository module) to a destination FRU (destination depository module) during a transaction being conducted on a transaction terminal that includes the depository.

In an embodiment, the diverter 300 is the diverter 103.

In an embodiment, the depository is the depository 100.

In an embodiment, the depository is integrated within one of: an ATM, a POS terminal, and a SST.

In an embodiment, the electromechanical components of the diverter 300 is controlled by the controller discussed above with the method 200 of the FIG. 2.

The diverter 300 includes: a first integrated divert gate (first divert gate 301) that is enclosed within four skid plates 305, 306, 307, and 308; a second integrated divert gate (second divert gate 302) also enclosed within the four skid plates 305, 306, 307, and 308; a first stepper motor 303 configured to selectively position and move the first divert gate 301; and a second stepper motor 304 configured to selectively position and move the second divert gate 302.

In an embodiment, the first divert gate 301 is the divert gate 103-1, the second divert gate 302 is the divert gate 103-13. In an embodiment, the first stepper motor 303 is the stepper motor 103-14 and the second stepper motor 304 is the stepper motor 103-15. In an embodiment, the four skid plates 305, 306, 307, and 308 are the skid plates 103-4, 103-5, 103-6, and 103-7.

The diverter 300 is configured to selectively position the first diver gate 301 through the first stepper motor 303 and selectively position the second divert gate 302 through the second stepper motor 304 to define a media path and to urge a media time from a source depository module (source FRU) to a destination depository module (destination FRU) through the diverter 300.

In an embodiment, the diverter 300 includes the four skid plates 305, 306, 307, and 308 as comprising: a first fixed skid plate 305, a second fixed skid plate 306, a third pivoting skid plate 307, and a fourth pivoting skid plate 308.

In an embodiment of the previous embodiment, the third pivoting skid plate 307 is configured to be unlatched from one end to expose and provide access to a portion of a particular media path through the valuable media diverter 300. This was illustrated and discussed in the FIG. 1I above. In an embodiment, the third pivoting skid plate 307 is the pivoting skid plate 103-6.

In an embodiment of the previous embodiment, the fourth pivoting skid plate 308 is configured to be unlatched from one end to expose and provide access to a portion of a different media path through the valuable media diverter 300. This was illustrated and discussed in the FIG. 1J above. In an embodiment, the fourth pivoting skid plate 308 is the pivoting skid plate 103-7.

In an embodiment, the diverter 300 further includes a bidirectional roller motor 309 configured to selectively activate bidirectional rollers when the source FRU or the destination FRU is associated with one or more of: a pocket module (pocket FRU) and a safe module (safe FRU). In an embodiment, the bidirectional motor 309 is the motor 103-18 and the bidirectional rollers are the rollers 103-16.

In an embodiment, the diverter 300 further includes a passive set of unidirectional rollers 310 configured to be controlled by a gear arrangement interfaced to an intermediate transfer device mounted external to the diverter 300 on a top of a safe module. In an embodiment, the passive set of unidirectional rollers 310 is the rollers 103-17. In an embodiment, the intermediate transfer device is the device 105-1. In an embodiment, the safe module is the safe FRU 105.

In an embodiment, the first stepper motor 303 and the second stepper motor 304 are configured to adjust positioning of the first divert gate 301 and the second divert gate 302 within a range of 120 degrees from initial positions of the first divert gate 301 and the second divert gate 302 to define five independent media paths within the diverter 300. The five independent media paths illustrated in the FIG. 1D above.

Figure 4:
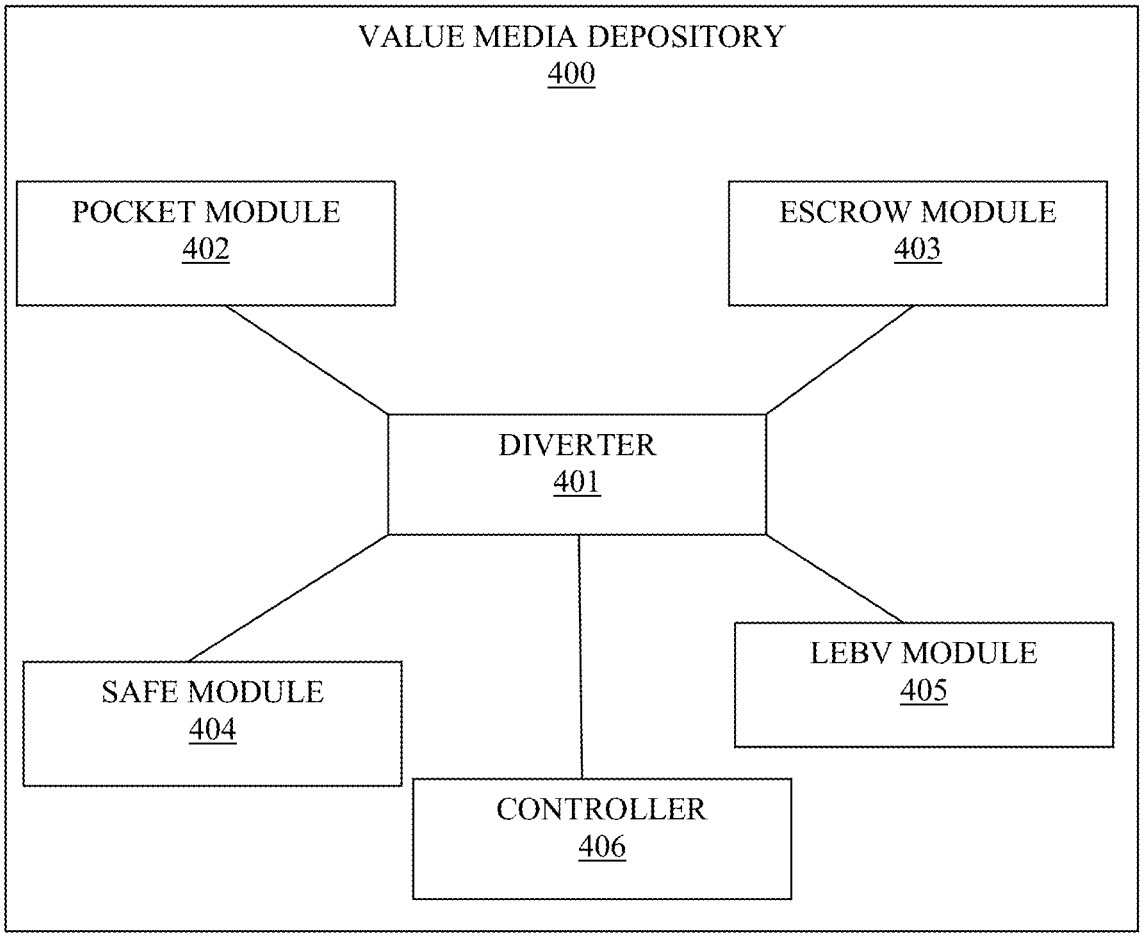
FIG. 4 is another diagram of the valuable media depository having the media diverter, according to an example embodiment.

FIG. 4 is another diagram of the valuable media depository 400 (depository 400) having the media diverter (diverter 402), according to an example embodiment. The valuable media depository 400 processes valuable media and includes a variety of mechanical, electrical, and software/firmware components, some of which were discussed above with reference to the FIGS. 1A-1M and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is a peripheral device integrated into an SST. In an embodiment, the SST is an ATM. In an embodiment, the valuable media depository 400 is a peripheral device integrated into a POS terminal.

The valuable media depository 400 includes a diverter 401, a pocket module 402 (pocket FRU 402 or just pocket 402), an escrow module 403 (escrow FRU 403 or just escrow 403), a safe module 404 (safe FRU 403 or just safe 404), a LEBV module 405 (LEBV FRU 405 or just LEBV 405), and a controller 406.

In an embodiment, the diverter 401 is the diverter 103.

In an embodiment, the pocket 402 is the pocket 101.

In an embodiment, the escrow 403 is the escrow 104.

In an embodiment, the safe 404 is the safe 105.

In an embodiment, the LEBV 405 is the LEBV 106.

In an embodiment, the controller is the controller discussed above in the FIGS. 1A-1M and 2-3.

The media diverter 401 includes: a first integrated divert gate 301 controlled by a first stepper motor 303, a second integrated divert gate 302 controlled by a second stepper motor 304, two pivoting skid plates 307 and 308, and two fixed skid plates 305 and 306. In an embodiment, the first divert gate 301 is the divert gate 103-1, the first stepper motor 303 is the stepper motor 103-14, the second divert gate 302 is the divert gate 103-13, the second stepper motor 304 is the stepper motor 103-15, the two pivoting skid plates 307 and 308 are the pivoting skid plates 103-6 and 103-7.

The two pivoting skid plates 307 and 308 and the two fixed skid plates 305 and 306 enclose the first divert gate 301 and the second divert gate 302.

The first stepper motor 303 and the second stepper motor 304 are configured to position the first divert gate 301 and the second divert gate 302 to define or provide a media path through the diverter 401 for purposes of urging a media item from a source valuable depository module (one of 402-405) to a destination valuable depository module (one of 402-405) through the diverter 401.

The controller 406 is configured to selectively activate the first stepper motor 303 and the second stepper motor 304 based on the source valuable media depository module and the destination valuable depository module for purposes of forming the media path for the media item.

In an embodiment, each of the two pivoting skid plates 307 and 308 are configured to be unlatched on one end to expose and provide access to different media paths within the valuable media diverter 401 to service media jams. The FIGS. 1I-1J illustrate the unlatching of two pivoting skid plates 103-6 and 103-7.

In an embodiment, the controller 406 is further configured to activate a bidirectional roller motor of the diverter 401 to selectively activate bidirectional rollers when at least one of the source valuable depository module and the destination valuable depository module is associated with the pocket 402 or the safe 404 of the valuable media depository 400.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

urging a media item, from a source depository module to a destination depository module along a media path defined by selectively moving at least one of two integrated divert gates, each of the two integrated divert gates moved by a separate stepper motor associated with that integrated divert gate; and controlling bidirectional rollers along at least a portion of the media path by a single bidirectional motor when at least one of the source depository module and the destination depository module is associated with either a pocket module or a safe module.

2. The method of claim 1, wherein urging further includes urging the media item along the media path that is along an inside portion of two pivoting skid plates and two fixed skid plates from a source infeed associated with the source depository module to a destination outfeed associated with the destination depository module.

3. The method of claim 1, wherein urging further includes controlling, by selective activation of the stepper motors, the bidirectional motor, and an intermediate transport device mounted on a top of the safe module: a belt gear/drivetrain arrangement to drive shafts/rollers defining the media path and contacting the media item for urging the media item along the media path from the source depository module to the destination depository module.

4. The method of claim 1, wherein urging further includes encasing the media item along at least one side of the media item by at least one of two vertically situated skid plates when the media item is urged along a first portion of the media path.

5. The method of claim 4, wherein encasing further includes using each of the two vertically situated skid plates as pivoting attached skid plates that are unlatchable to provide service access to the first portion of the media path when the media item is jammed along the first portion of the media path.

6. The method of claim 4, wherein encasing further includes encasing the media item along the at least one side of the media item by at least one of two horizontally situated and fixed skid plates when the media item is urged along another portion of the media path.

7. The method of claim 1, wherein urging further includes forming the media path by selectively positioning the at least one of the two integrated divert gates in order to establish a particular pathway from the source depository module to the destination depository module, and selecting the source depository module and the destination depository module from two of: the pocket module, the safe module, an escrow module, and a Long Edge Bill Validator (LEBV) module.

8. The method of claim 1, wherein urging further include selectively moving the at least one of the two integrated divert gates within a range of approximately 120 degrees from an initial configured position of the at least one of the two integrated divert gates and based on the media path.

9. The method of claim 1 further comprising, activating unidirectional rollers responsive to control provided by an intermediate transport device interface situated at an ingress and egress point into a safe module, the intermediate transport device interface mounted on a top of the safe module.

10. A valuable media diverter, comprising:

a first integrated divert gate enclosed within four skid plates;

a second integrated divert gate enclosed within the four skid plates;

a first stepper motor configured to selective position and move the first integrated divert gate; and a second stepper motor configured to selectively position and move the second integrated divert gate;

wherein the valuable media diverter is configured to selectively position the first integrated divert gate through the first stepper motor and selectively position the second integrated divert gate through the second stepper motor to define a media path to urge a media item from a source depository module to a destination depository module through the valuable media diverter.

11. The valuable media diverter of claim 10 further comprising, the four skid plates comprising: a first fixed skid plate, a second fixed skid plate, a third pivoting skid plate, and a fourth pivoting skid plate.

12. The valuable media diverter of claim 11, wherein the third pivoting skid plate is configured to be unlatched from one end to expose and provide access to a portion of a particular media path through the valuable media diverter.

13. The valuable media diverter of claim 12, wherein the fourth pivoting skid plate is configured to be unlatched from one end to expose and provide access to a portion of a different media path through the valuable media diverter.

14. The valuable media diverter of claim 10 further comprising, a bidirectional roller motor configured to selective activate bidirectional rollers when the source depository module or the destination depository module is associated with one or more of: a pocket module and a safe module.

15. The valuable media diverter of claim 10 further comprising, a passive set of unidirectional rollers configured to be controlled by a gear arrangement interfaced to an intermediate transfer device mounted external to the valuable media diverter on a top of a safe module.

16. The valuable media diverter of claim 10, wherein the first stepper motor and the second stepper motor are configured to adjust the positioning of the first integrated divert gate and the second integrated divert gate within a range of 120 degrees from initial positions of the first integrated divert gate and the second integrated divert gate to define five media paths within the valuable media diverter.

17. A valuable media depository, comprising:

a controller; and a media diverter comprising:

a first integrated divert gate configured to be controlled by a first stepper motor;

a second integrated divert gate configured to be controlled by a second stepper motor;

two pivoting skid plates; and two fixed skid plates;

wherein the two pivoting skid plates and the two fixed skid plates enclose the first integrated divert gate and the second integrated divert gate;

wherein the first stepper motor and the second stepper motor are configured to position the first integrated divert gate and the second integrated divert gate to define a media path to urge a media item from a source valuable depository module to a destination valuable depository module through the media diverter;

wherein the controller configured to selectively activate the first stepper motor and the second stepper motor based on the source valuable depository module and the destination valuable depository module.

18. The valuable depository of claim 17 further comprising: a pocket module, an escrow module, a safe module, and a Long Edge Bill Validator (LEBV) module.

19. The valuable depository of claim 17, wherein each of the two pivoting skid plates are configured to be unlatched on one end to expose and provide access to different media paths within the valuable media diverter to service media jams.

20. The valuable depository of claim 17, wherein the controller is further configured to activate a bidirectional roller motor of the valuable media diverter to selectively activate bidirectional rollers when at least one of the source valuable depository module and the destination valuable depository module is associated with a pocket module or a safe module of the valuable media depository.

* * * * *